US007201336B2

(12) United States Patent
Blette et al.

(10) Patent No.: US 7,201,336 B2
(45) Date of Patent: Apr. 10, 2007

(54) LIQUID SPRAY GUN WITH NON-CIRCULAR HORN AIR OUTLET PASSAGEWAYS AND APERTURES

(75) Inventors: Russell E. Blette, Hastings, MN (US); Franklyn L. Frederickson, White Bear Lake, MN (US); Stephen C. P. Joseph, Woodbury, MN (US); Jameel R. Qiblawi, North Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 156 days.

(21) Appl. No.: 10/748,479

(22) Filed: Dec. 30, 2003

(65) Prior Publication Data

US 2005/0145723 A1 Jul. 7, 2005

(51) Int. Cl.
*A62C 31/02* (2006.01)
*B05B 1/26* (2006.01)

(52) U.S. Cl. ..... 239/601; 239/290; 239/296; 239/297; 239/300; 239/301; 239/398; 239/525; 239/526

(58) Field of Classification Search ..... 239/601, 239/290, 296, 297, 300, 301, 398, 525, 526, 239/291
See application file for complete search history.

(56) References Cited

U.S. PATENT DOCUMENTS 1,751,787 A 3/1930 Binks
1,990,823 A 2/1935 Gustafsson
2,497,625 A 2/1950 Norwick
3,746,253 A 7/1973 Walberg
4,171,096 A 10/1979 Welsh et al.
4,728,039 A 3/1988 Johnson et al.
4,917,300 A * 4/1990 Gloviak et al. ..... 239/290
5,090,623 A 2/1992 Burns et al.
5,102,051 A 4/1992 Smith et al.

(Continued)

FOREIGN PATENT DOCUMENTS

EP 0 092 392 A2 10/1983

(Continued)

OTHER PUBLICATIONS

U.S. Appl. No. 10/112,182, titled "Small Liquid Supply Assembly", filed Mar. 28, 2002.

(Continued)

*Primary Examiner*—David A. Scherbel
*Assistant Examiner*—James S. Hogan
(74) *Attorney, Agent, or Firm*—William L. Huebsch

(57) ABSTRACT

The present invention provides a liquid spray gun with several improved features, including (1) non-cylindrical air passageways on air horns included in an air cap portion of a body assembly that provide improved shape and uniformity for the wide elongate stream of liquid formed by the spray gun; (2) the air cap portion of the body assembly being mounted for manual rotation on a nozzle portion of the body assembly between positions defined by stops and retained at those positions by friction; and (3) the body assembly through which passes liquid sprayed by the spray gun being molded of polymeric material and being manually releasable from a metal platform portion of the spray gun through which air is fed to passageways through the body assembly to spray the liquid.

11 Claims, 7 Drawing Sheets

U.S. PATENT DOCUMENTS

| | | | | |
|---|---|---|---|---|
| 5,165,605 | A * | 11/1992 | Morita et al. | 239/296 |
| 5,209,405 | A | 5/1993 | Robinson et al. | |
| 5,259,558 | A | 11/1993 | Smith et al. | |
| 5,267,693 | A * | 12/1993 | Dickey | 239/417.3 |
| 5,307,994 | A * | 5/1994 | Hieronymus | 239/340 |
| 5,322,221 | A | 6/1994 | Anderson | |
| 5,344,078 | A | 9/1994 | Fritz et al. | |
| 5,584,433 | A * | 12/1996 | Nakagawa | 239/8 |
| 5,639,027 | A | 6/1997 | Fritz | |
| 5,803,367 | A * | 9/1998 | Heard et al. | 239/296 |
| 6,098,902 | A | 8/2000 | Culbertson et al. | |
| 6,588,681 | B2 | 7/2003 | Rothrum et al. | |
| 6,612,506 | B1 | 9/2003 | Huang | |
| 2002/0080207 | A1 | 6/2002 | Kanda et al. | |
| 2002/0148910 | A1 | 10/2002 | Reetz, III et al. | |
| 2003/0052190 | A1 | 3/2003 | Ulrich et al. | |

FOREIGN PATENT DOCUMENTS

| | | |
|---|---|---|
| EP | 0 885 658 A2 | 12/1998 |
| GB | 582605 | 11/1946 |

OTHER PUBLICATIONS

U.S. Appl. No. 10/279,518, titled "Pressure Assisted Liquid Supply Assembly", filed Oct. 24, 2002.

* cited by examiner

LIQUID SPRAY GUN WITH NON-CIRCULAR HORN AIR OUTLET PASSAGEWAYS AND APERTURES

FIELD OF THE INVENTION

This invention relates to liquid spray guns of the type comprising a body assembly having a liquid passageway with an outlet end opening through an outlet end of a nozzle portion, which body assembly has a first air passageway having an outlet end around the outlet end of the liquid passageway shaped to direct high velocity air against liquid flowing out of the outlet end of the liquid passageway to propel the liquid away from the nozzle portion while shaping the liquid into a generally conical stream about an axis; the body assembly including horns projecting past the outlet end of the nozzle portion on opposite sides of the axis, and having a second air passageway extending to outlet passageways and apertures spaced along the horns from the outlet end of the nozzle portion and facing opposite sides of the axis, which horn outlet passageways and apertures are positioned to direct high velocity air against opposite sides of a stream of liquid formed by air flowing through the first air passageway to reshape that generally conical stream into a wide elongate stream.

BACKGROUND OF THE INVENTION

The prior art is replete with liquid spray guns of the type comprising a body assembly having a liquid passageway with an outlet end opening through an outlet end of a nozzle portion, which body assembly has a first air passageway having an outlet end around the outlet end of the liquid passageway shaped to direct high velocity air against liquid flowing out of the outlet end of the liquid passageway to propel the liquid away from the nozzle portion while shaping the liquid into a generally conical stream about an axis; the body assembly including an air cap having horns projecting past the outlet end of the nozzle on opposite sides of the axis, and having a second air passageway extending to outlet passageways and apertures spaced along the horns from the outlet end of the nozzle and facing opposite sides of the axis, which horn outlet passageways and apertures are positioned to direct high velocity air against opposite sides of a stream of liquid formed by air flowing through the first air passageway to reshape that generally conical stream into a wide elongate stream that is directed against a surface to which the liquid (e.g., paint) is being applied. U.S. Pat. No. 1,751,787 (Binks); U.S. Pat. No. 1,990,823 (Gustopsson); U.S. Pat. No. 3,746,253 (Walberg); U.S. Pat. No. 5,090,623 (Burns et al.); U.S. Pat. No. 5,102,051 (Smith et al); U.S. Pat. No. 5,209,405 (Robinson et al); U.S. Pat. No. 5,322,221 (Anderson); U.S. Pat. No. 5,344,078 (Fritz et al.) and U.S. Pat. No. 5,803,367 (Heard et al.) and U.S. patent application Publication No. US 2002/0148910 A1 published Oct. 17, 2002, provide illustrative examples.

Many patterns of outlet passageways and apertures in the horns of such spray guns have been used in an attempt to form a wide elongate stream of liquid that is as uniform as possible in width and in the amount of liquid delivered per unit time along its length to facilitate uniform application of the liquid to a surface. In all known liquid spray guns of this type the air outlet passageways along the horns are cylindrical, typically having been formed by drilling into the horns on the air cap after the air cap is formed. Air flows out of such cylindrical passageways in generally cylindrical streams that impact the side of the stream of liquid. While such cylindrical air streams from cylindrical passageways placed on the horns can form a wide elongate stream of liquid, the uniformity of the width of that stream and the uniformity in the amount of liquid delivered per unit time along its length are not as good as may be desired because such cylindrical air streams do not apply a uniform amount of energy across their diameters against the side of the stream of liquid.

DISCLOSURE OF THE INVENTION

The present invention provides a liquid spray gun that can provide an improved shape and distribution of liquid flow within the wide elongate stream of liquid formed by the spray gun.

According to the present invention there is provided a liquid spray gun comprising a body assembly including a nozzle portion with an outlet end. The nozzle portion has a liquid passageway extending to an outlet end opening through the outlet end of the nozzle portion. The body assembly also has a first air passageway extending to an outlet end at the outlet end of the nozzle portion. That outlet end of the first air passageway extends around the outlet end of the liquid passageway and is shaped to direct high velocity air against liquid flowing out of the outlet end of the liquid passageway to propel the liquid away from the outlet end of the nozzle portion while shaping the liquid into a generally conical stream about an axis. The body assembly includes horns projecting past the outlet end of the nozzle portion on opposite sides of the axis, and the body assembly has a second air passageway extending from through portions of the horns to outlet passageways and apertures spaced along the horns from the outlet end of the nozzle and facing opposite sides of the axis. Those outlet passageways are non-circular and are shaped to direct high velocity air flowing through the second air passageway against opposite sides of a stream of liquid formed by air flowing through the first air passageway to reshape that generally conical stream of liquid into a wide elongate stream.

Those non-circular outlet passageways can have a greater width in a direction at a right angle to the axis than depth in a direction parallel to the axis (e.g., the outlet passageways can be generally rectangular) which has been found to form a liquid stream that is very uniform in width and in the amount of liquid delivered per unit time along its length to facilitate uniform application of the liquid to a surface.

The body assembly can include an air cap including the horns that is molded of polymeric material, with the non-circular passageways leading to the outlet apertures being formed during the molding process. Means are provided for mounting the molded polymeric air cap portion on the nozzle portion, with the molded air cap and the nozzle portion having surfaces forming the first and second air passageways. The means mounting the air cap portion on the nozzle portion can allow rotation of the air cap portion about the axis relative to the nozzle portion, and the air cap and nozzle portions can include stops limiting relative rotation of the air cap and nozzle portions to rotation through a predetermined angle (e.g., about 90 degrees) between first and second relative positions. Also, the means mounting the air cap portion on the nozzle portion can include surfaces in frictional engagement with each other to restrict relative rotation of the air cap and nozzle portions until a predetermined torque is manually applied between the air cap and nozzle portions.

The nozzle portion as well as the air cap portion can be molded of polymeric material, and the liquid spray gun can further include a reusable platform portion (e.g., of metal) having through air distribution passageways including an inlet opening adapted to be connected to a supply of air under greater than atmospheric pressure, first and second air outlet openings, means for separately regulating the flow of air through the first and second air outlet openings of the air distribution passageways when air is flowing through the air distribution passageways, and manually operated means for stopping or allowing flow of air through the outlet openings of the air distribution passageways. The reusable platform portion and the polymeric nozzle portion can then have manually operable means (i.e., means manually operable by a person without the use of tools) for releasably mounting the nozzle portion on the reusable platform portion with the first and second air outlet openings of the air distribution passageways communicating with inlet ends of the first and second passageways. The molded air cap and nozzle portions can be sufficiently inexpensive that they can be discarded rather than cleaned for some applications

BRIEF DESCRIPTION OF THE DRAWINGS

The present invention will be further described with reference to the accompanying drawings wherein like reference numerals refer to like or corresponding parts throughout the several views, and wherein.

DETAILED DESCRIPTION OF THE INVENTION

Figure 1:
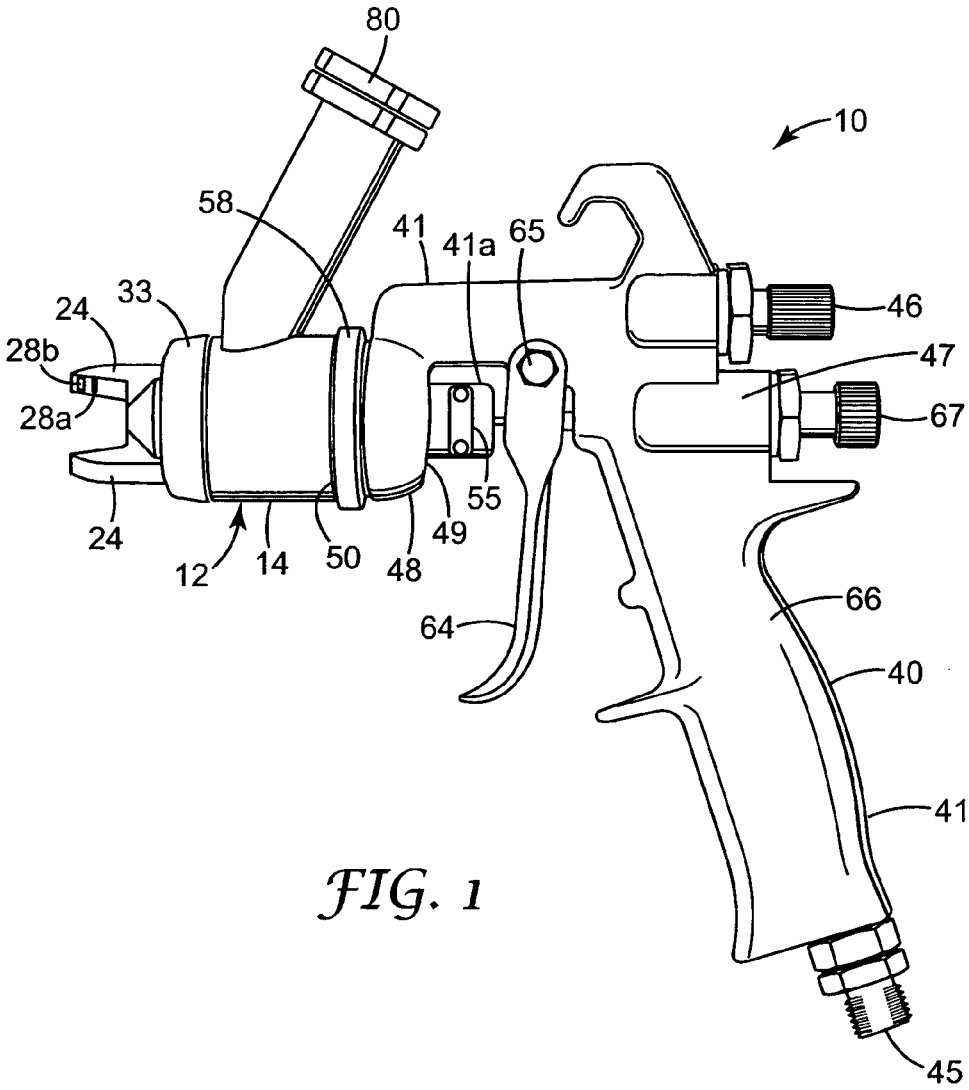
FIG. 1 is a side view of a liquid spraying device according to the present invention

Referring now to the drawing there is illustrated a liquid spraying device or spray gun 10 according to the present invention. Generally, the liquid spray gun 10 comprises a body assembly 12 including a nozzle portion 14 with an outlet end 15. The nozzle portion 14 has a liquid passageway 16 extending from an inlet end 17 to an outlet end 18 opening through the outlet end 15 of the nozzle portion 14. The body assembly 12 also has a first air passageway 20 extending from an inlet end 21 to an outlet end 22 at the outlet end 15 of the nozzle portion 14. The outlet end 22 of the first air passageway 20 extends around the outlet end 18 of the liquid passageway 16 and is shaped to direct air under greater than atmospheric pressure against liquid flowing out of the outlet end 18 of the liquid passageway 16 to propel liquid flowing out of the liquid passageway 16 away from the outlet end 15 of the nozzle portion 14 while shaping the liquid into a generally conical stream about an axis 23. The body assembly 12 includes horns 24 projecting past the outlet end 15 of the nozzle portion 14 on opposite sides of that axis 23, and the body assembly 12 has a second air passageway 26 extending from an inlet end 27 through portions of the horns 24 to outlet passageways 28 having outlet apertures spaced along the horns 24 from the outlet end 15 of the nozzle portion 14 and facing opposite sides of the axis 23. The outlet passageways 28 and apertures are non-circular and are shaped to direct air under greater than atmospheric pressure flowing through the second air passageway 26 against opposite sides of a generally conical stream of liquid formed by air flowing through the first air passageway 20 to reshape that generally conical stream of liquid into a wide elongate stream. The outlet passageways 28 and apertures are generally rectangular and have a greater width in a direction at a right angle to the axis 23 than depth in a direction parallel to the axis.

As a non-limiting example, as illustrated the outlet passageways 28 and apertures can comprise first and second pairs 28*a* and 28*b* of opposed outlet passageways 28 and apertures on the horns 24, the first pair of outlet passageways 28*a* and apertures each having a width in a direction at a right angle to the axis 23 of about 0.154 inch or 0.39 cm, a depth in a direction parallel to the axis 23 of about 0.35 inch or 0.89 cm, and being spaced about 0.25 inch or 0.64 cm from the outlet end 15 of the nozzle portion 14, with the outlet passageways 28*a* being disposed at an angle of about 66 degrees with respect to the axis; and the second pair of outlet passageways 28*b* and apertures each having a width in a direction at a right angle to the axis 23 of about 0.165 inch or 0.42 cm, a depth in a direction parallel to the axis of about 0.050 inch or 0.13 cm, and being spaced about 0.35 inch or 0.89 cm from the outlet end 15 of the nozzle portion 14 with the outlet passageways 28*b* being disposed at an angle of about 75 degrees with respect to the axis 23.

The body assembly 12 includes an air cap portion 30 including the horns 24 that is preferably molded of a polymeric material (e.g., polypropylene, polyethylene, or glass filled nylon), with the outlet passageways 28 and apertures being formed by the molding process. The body assembly 12 also includes means for mounting the air cap portion 30 on the nozzle portion 14 so that adjacent surfaces of the air cap portion 30 and the nozzle portion 14 form parts of the first and second air passageways 20 and 26. The means mounting the air cap portion 30 on the nozzle portion 14 includes a radially outwardly projecting annular ring 32 around the outlet end 15 of the nozzle portion 14 co-axial with the axis 23, and a generally cylindrical collar 33 on the air cap portion 30 having an annular recess 34 from its inner surface adapted to receive the annular ring 32 of the nozzle portion 14. The collar 33 on the air cap portion 30 is sufficiently resiliently flexible that the inner surface of the collar 33 can be pressed over the annular ring 32 to position the ring 32 in the recess 34. A cylindrical part 35 of the inner surface of the air cap portion has a close sliding fit around an outer surface of a cylindrical portion 37 of the nozzle portion 14 to separate the first and second air passageways 20 and 26. This means for mounting the air cap portion 30 on the nozzle portion allows rotation of the air cap portion 30 about the axis 23 relative to the nozzle portion 14. The air cap and nozzle portions 30 and 14 include stops 36 and 38 respectively that limit relative rotation of the air cap and nozzle portions 30 and 14 to rotation through a predetermined angle (90 degrees as illustrated) between first and second relative positions. This means mounting the air cap portion 30 on the nozzle portion 14 also includes surfaces on the air cap and nozzle portions 30 and 14 in frictional engagement (i.e., such engagement can be with each other as illustrated or, alternatively, could be with a frictional layer, not shown, between the air cap and nozzle portions 30 and 14) to restrict relative rotation of the air cap and nozzle portions 30 and 14 until a predetermined torque is manually applied between the air cap and nozzle portions 30 and 14. That predetermined torque should be enough to restrict rotation of the air cap portion 30 on the nozzle portion 14 by slight contact with the air cap portion, but not so much that it is difficult to manually rotate the nozzle portion 14 on the air cap portion 30. Such torque should thus be in the range of 5 to 40 inch pounds, and more preferably in the range of 10 to 20 inch pounds. An O-ring 39 is positioned between the air cap and nozzle portions 30 and 14 to restrict leakage between the collar 33 and the nozzle portion 14.

The outlet end 22 of the first air passageway 20 is shaped to direct a peripheral portion of air exiting the first air passageway 20 in a converging conical pattern (e.g., converging at an angle in the range of about 30 to 45 degrees with respect to the axis 23 against liquid exiting the outlet end 18 of the liquid passageway 16. This converging conical pattern better atomizes the liquid leaving the outlet end 18 of the liquid passageway 16 than would air flowing out of the outlet end 22 of the first air passageway 20 in a direction parallel to the stream of fluid leaving the outlet end 18 of the liquid passageway 16.

Figure 3:
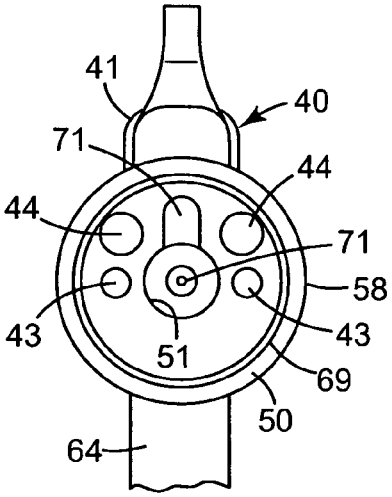
FIG. 3 is an enlarged front view of the platform portion of the liquid spraying device as seen along line 3—3 of FIG. 2.
Figure 4:
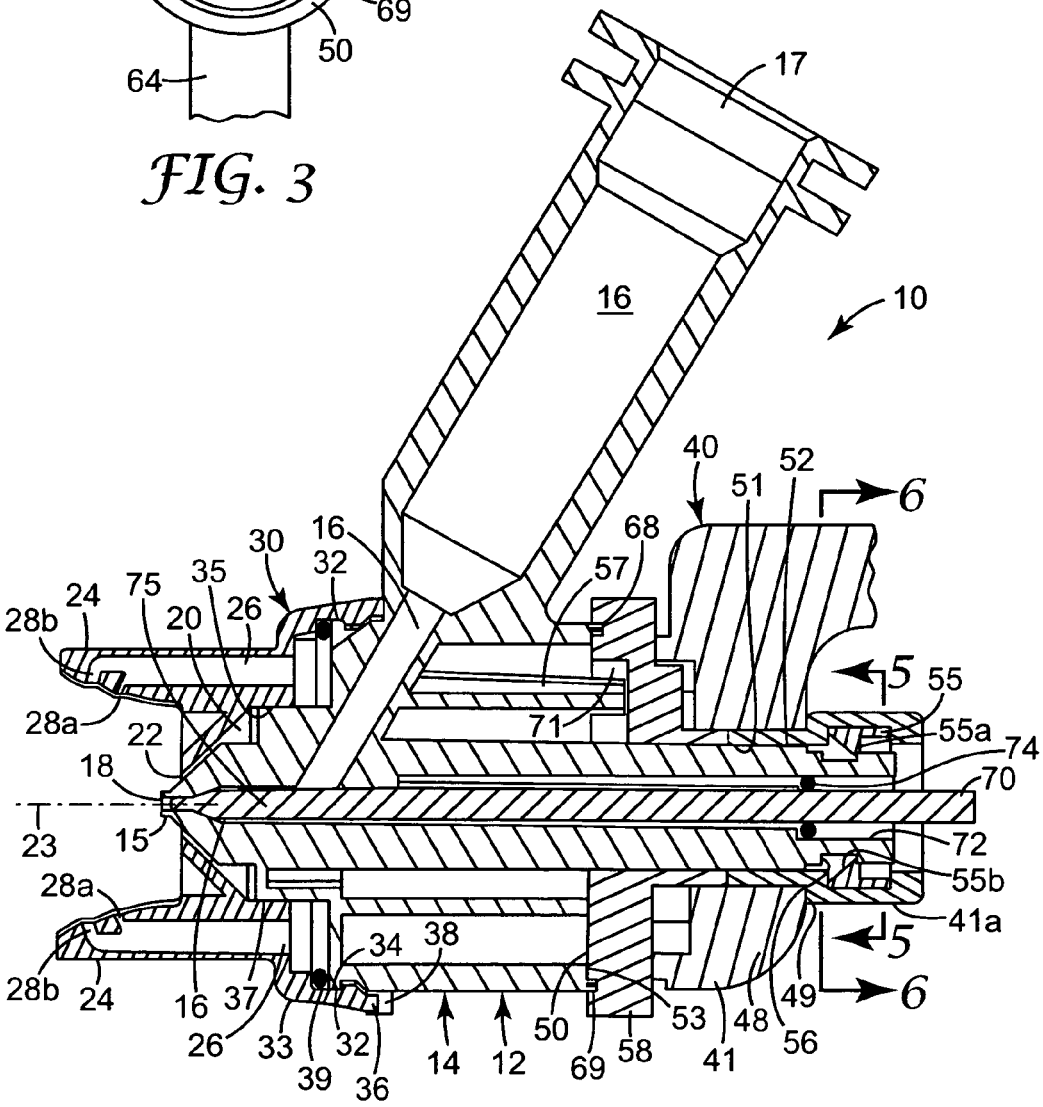
FIG. 4 is a enlarged fragmentary vertical cross sectional view of the liquid spraying device of FIG. 1.
Figure 5:
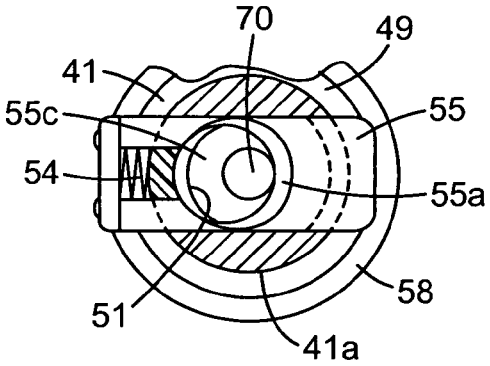
FIG. 5 is a sectional view taken approximately along line 5—5 of FIG. 4 after the nozzle portion is removed from the platform portion.
Figure 6:
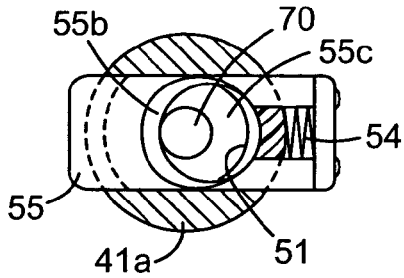
FIG. 6 is a sectional view taken approximately along line 6—6 of FIG. 4 after the nozzle portion is removed from the platform portion.
Figure 7:
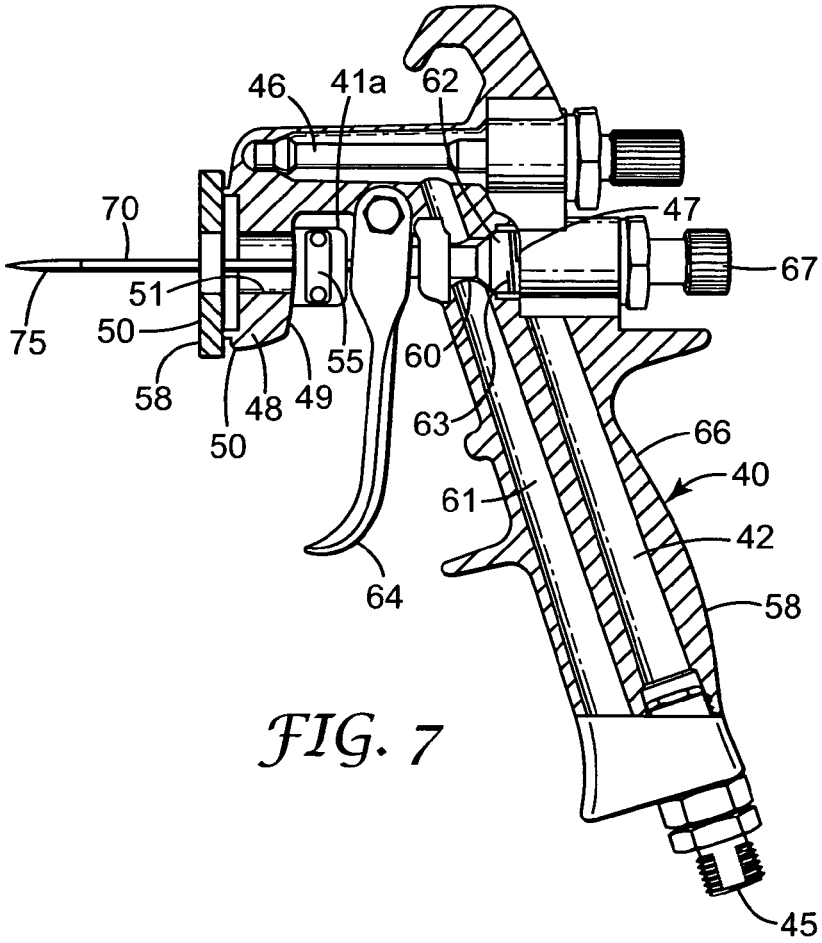
FIG. 7 is a side view of the platform portion of the liquid spraying device of FIG. 1 which has been partially sectioned to show detail.
Figure 8:
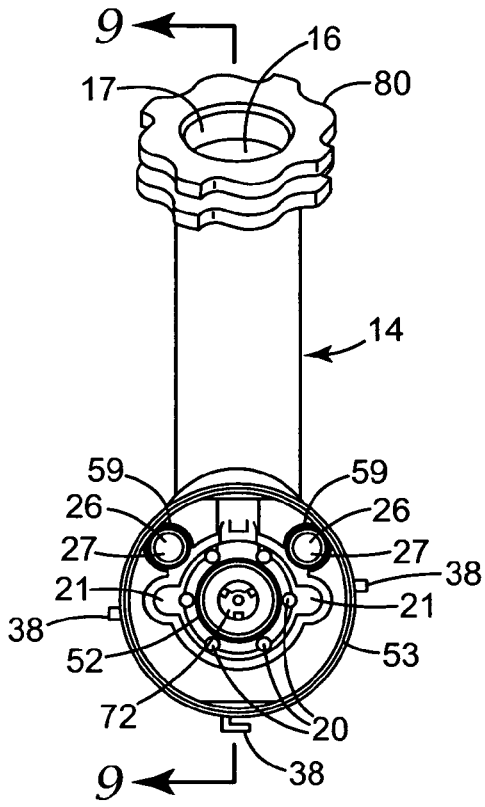
FIG. 8 is a rear view of the nozzle portion included in the spraying device of FIG. 1.
Figure 9:
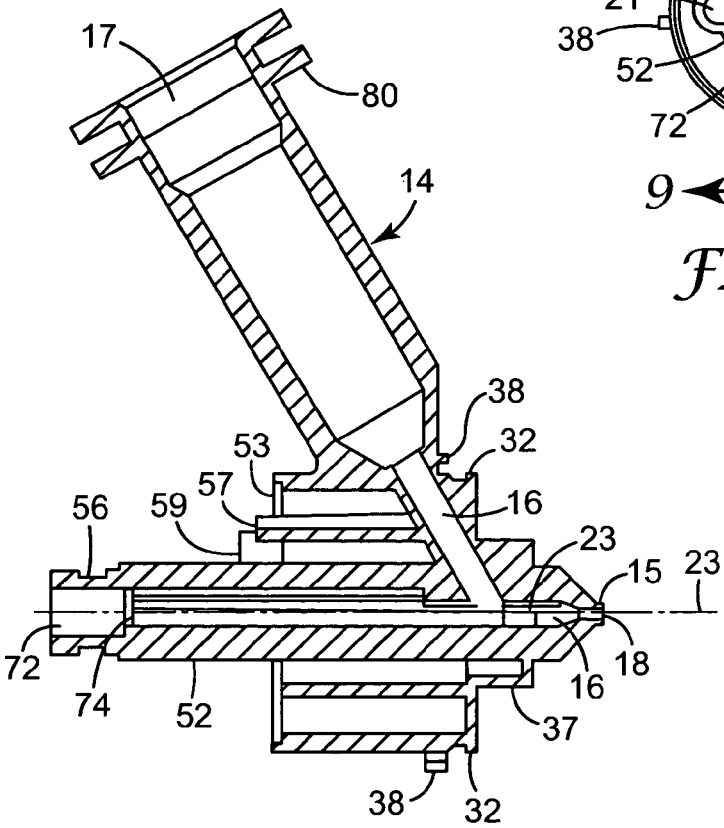
FIG. 9 is a sectional view taken approximately along line 9—9 of FIG. 8.
Figure 10:
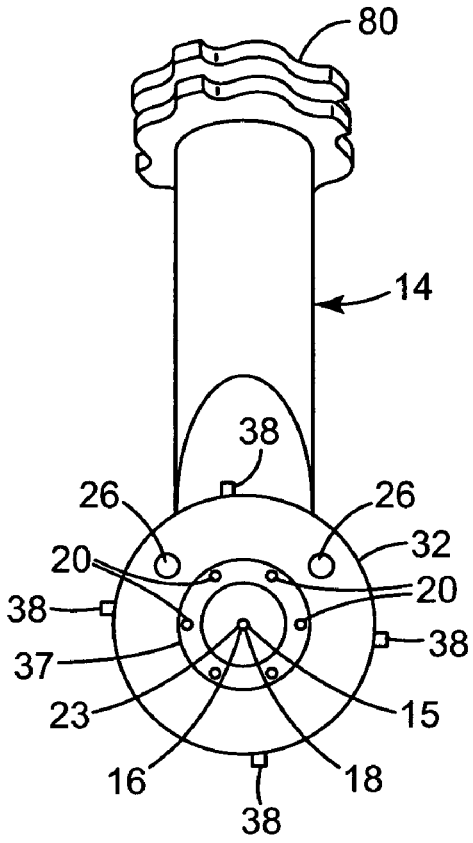
FIG. 10 is a front view of the nozzle portion of FIG. 2.
Figure 11:
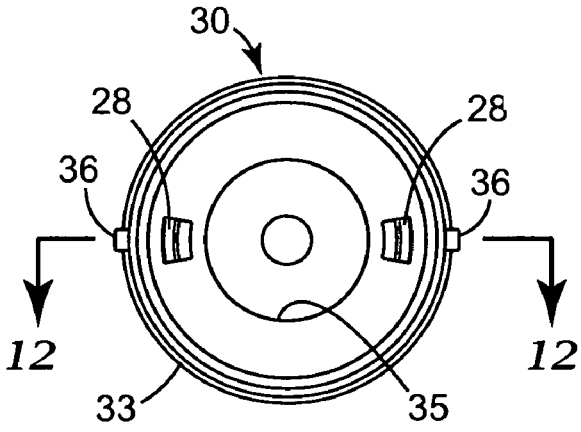
FIG. 11 is an enlarged rear view of the air cap portion included in the spraying device of FIG. 1.
Figure 12:
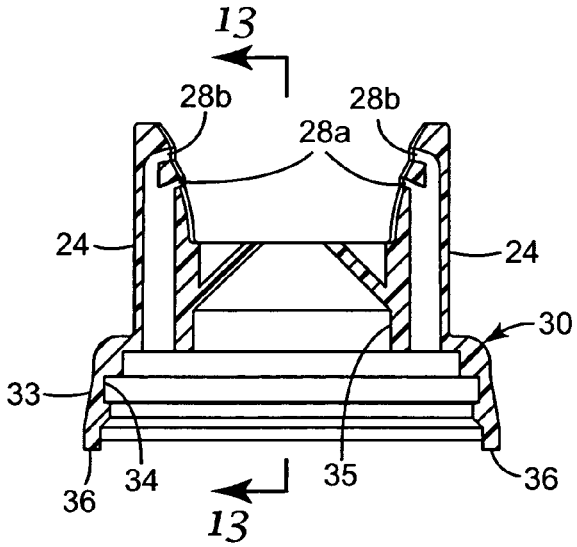
FIG. 12 is a sectional view taken approximately along line 12—12 of FIG. 11.

The liquid spray gun 10 further includes a platform portion 40 including a frame 41 having through air distribution passageways including an inlet passageway 42 (see FIGS. 3 and 7) with an inlet end 45 adapted to be connected to a supply of air under greater than atmospheric pressure, first and second air outlet openings 43 and 44, means in the form of an adjustable valve member 46 for regulating the portion of air flow through the air distribution passageways that can flow to the second air outlet opening 44, and manually operated valve means 47 for stopping or allowing flow of air from the inlet passageway 42 to the outlet openings 43 and 44 of the air distribution passageways. The platform portion 40 and the nozzle portion 14 have manually operable means for releasably mounting the nozzle portion 14 on the platform portion 40 with the first and second air outlet openings 43 and 44 of the air distribution passageways communicating with the inlet ends 21 and 27 of the first and second air passageways 20 and 26 respectively. That manually operable means (see FIG. 4) comprises the platform portion 40 including a support wall 48 having opposite inner and outer surfaces 49 and 50, a cylindrical opening 51 through the support wall 48 between its inner and outer surfaces 49 and 50; and the nozzle portion 14 including a projection 52 beyond a contact surface 53 on the side of the nozzle portion 14 opposite its outlet end 18. The projection 52 is received in the opening 51 through the support wall 48 with the contact surface 53 against its outer surface 50 and a distal part of the projection 52 projecting past the inner surface 49 of the support wall 48. The distal part of the projection 52 has a transverse annular groove 56, and the manually operable means further includes a plate-like latch member 55 mounted on the frame 41 for sliding movement transverse of the opening 51 between (1) an engaged position at which a generally C-shaped portion of the latch member 55 having a latching surface 55*a* facing away from the support wall 48 that is about normal to the axis of the opening 51 will be positioned in a portion of the transverse groove 56 if the projection 52 is fully engaged in the opening 51 to retain the projection 52 and thereby the nozzle portion 14 in engagement with the platform portion 40, and (2) a release position to which the latch member 55 can be manually slid against the bias of a spring 54 between the latch member 55 and the frame 41 that biases the latch member 55 to its engaged position, at which release position a circular opening 55*c* through the latch member 55 larger in diameter than the projection 52 is aligned with the projection 52 to allow the nozzle portion 14 to be mounted on or removed from the platform portion 40. The latch member 55 includes a cam surface 55*b* on its side opposite the latching surface 55*a* that faces the support wall 48 and is disposed at an angle (e.g., about 45 degrees) with respect to the axis of the opening 51 so that pressing the distal end of the projection 52 against the cam surface 55*b* will cause the latch member 55 to move to its release position and allow the distal end of the projection 52 to move past the latch member 55 until the projection 52 is fully engaged in the opening 51, whereupon the latching surface 55*a* will move into engagement with a portion of the transverse groove 56 (the latching position of the latch member 55) under the influence of the spring 54 to retain the projection 52 and thereby the nozzle portion 14 in engagement with the platform portion 40.

The platform portion 40 can be made by modifying a metal spray gun that is commercial available under the trade designation "HVLP Gravity feed spray gun" from Graco, Minneapolis, Minn., by adding to the frame 41 a portion 41*a* for mounting the latch member 55 described above and by adding to the frame 41 a plate 58 which provides the outer surface 50 shaped for sealing engagement with the contact surface 53 on the nozzle portion 14, and in which the first and second air outlet openings 43 and 44 are formed. The second air outlet openings 44 are defined by sockets adapted to closely receive projecting tubular portions 59 that are at the inlet ends 27 of the second air passageways 26 in the nozzle portion 14. The plate 55 has an opening 71 adapted to closely receive a projection 57 on the nozzle portion 14 to help locate the nozzle portion 14 on the plate 58, and has a groove 69 around its periphery adapted to receive in sealing engagement a projecting lip 68 around the periphery of the nozzle portion 14.

The manually operated valve means 46 (see FIG. 7) for stopping or allowing flow of air from the inlet passageway 42 to the outlet openings 43 and 44 of the air distribution passageways includes a valve seat on the frame 41 around an opening 60 between the inlet passageway 42 and a second air passageway 61 included in the air distribution passageways that is parallel to the inlet passageway 42. The valve member 62 is mounted on the frame 41 for movement between (1) a closed position engaging that seat to prevent flow of air through the opening 60 to which closed position the valve member 62 is biased by a spring 63 between the valve member 62 and the frame 41, and (2) positions spaced from the seat around that opening 60 to allow various rates of air to flow from the inlet passageway 42 to the second air passageway 61, and from there to the first outlet openings 43 and to the second outlet openings 44 if the valve member 46 is open. Such movement of the valve member 62 to positions spaced from the seat can be caused by manually pulling a trigger member 64 pivotally mounted on the frame 41 by a pin 65 toward a handle portion 66 of the frame 41. The amount of such movement that can be caused by pulling the trigger member 64 is determined by a stop member 67 in threaded engagement with the frame 41 so that the maximum amount of such movement is adjustable. A fluid flow control needle 70 is attached to the valve member 62. The fluid flow control needle 70 extends through a central bore 72 in the projection 52 and through a seal 74 in the bore 72 around its periphery which separates part of the liquid passageway 16 adjacent its outlet end 18 from the opposite end of that bore 72 (see FIG. 4). A generally conical end portion 75 of that needle 70 is positioned against the inner surface of and closes the liquid passageway 16 adjacent its outlet end 18 when the valve member 62 is positioned in its closed position to which it is biased by the spring 63. The end portion 75 of that needle 70 moves away from the inner surface of the liquid passageway 16 to allow liquid to flow through it when the trigger member 64 is manually moved toward the handle portion 66 and away from its closed position against the bias of the spring 63. The end portion 75 of the needle is formed of polymeric material and tapered at a much smaller angle than the valve member 62 so that the valve member 62 will open to allow air to flow through the outlet openings 43 and 44 of the air distribution passageways, through the first and second air passageways 20 and 26, out of the outlet end 22 of the first air passageway 20, and out of the outlet passageways 28 of the second air passageway 26 (if the valve member 46 is open) before fluid can flow out of the outlet end 18 of the liquid passageway 16.

Liquid can be gravity fed to the outlet end 15 of the liquid passageway 16 from a suitable container at its inlet end 17, which container could be the container described in U.S. Pat. No. 6,588,681 that includes a portion of a connector adapted for manually releasable engagement with a connector portion 80 illustrated about the inlet end 17 of the liquid passageway 16. Alternatively, smaller volume liquid containers such as those described in U.S. Pat. No. 6,752,179 could ho used.

Figure 2:
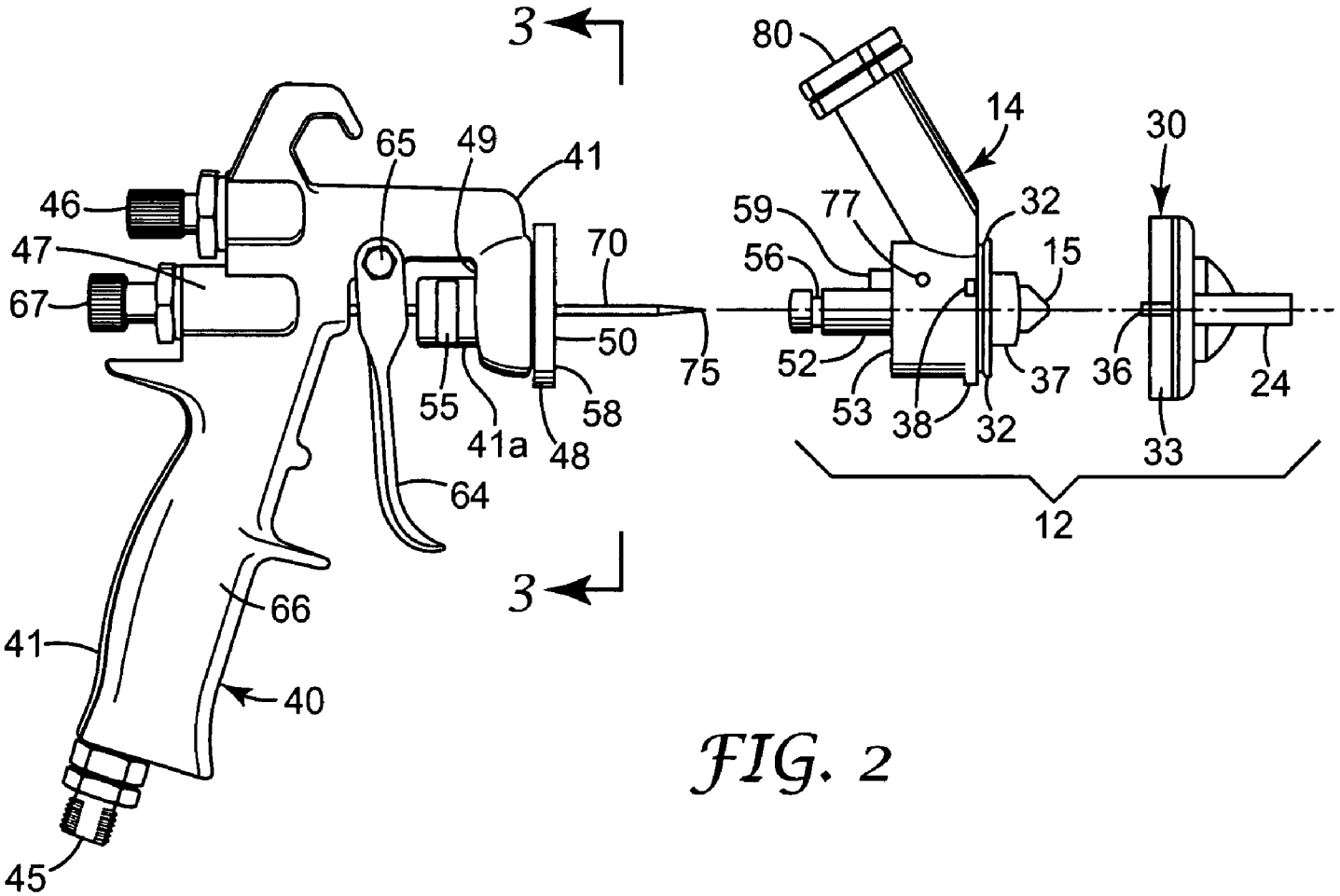
FIG. 2 is an opposite side view of the liquid spraying device of FIG. 1 in which a nozzle portion, an air cap portion and a platform portion of the spraying device are separated from each other.

Optionally, a pressure tap 77 (see FIG. 2) communicating with the second air passageway 26 and closed when not used could be provided to supply air pressure to the pressurized liquid container described in U.S. Patent Application Publication No. US 2004/0084553 A1, publilshed May 6, 2004, which pressurized liquid container could be used to supply liquid to the liquid passageway 16 of the spray gun 10. The pressure tap 77 should communicate with the second air passageway 26 at a position spaced (e.g. over 1 inch or 2.54 cm) from the outlet passageways 28 and outlet apertures in the air horns 24 so that it does not cause air pressure differences between the two horns 24.

The content of the aforementioned U.S. Pat. Nos. 6,588,681 and 6,752,179 and U.S. Patent Application Publication No. US 2004/0084553 A1 are hereby incorporated herein by reference.

The body assembly 12 including both the nozzle portion 14 and the air cap portion 30 can be molded of a suitable polymeric material (e.g., polypropylene, polyethylene, or glass filled nylon). The body assembly 12, and particularly its nozzle portion 14 will make most of the contact with a liquid (e.g., paint) being sprayed (i.e., only the needle 70 on the platform portion 40 will contact that liquid), and the molded body assembly 12 can be sufficiently inexpensive that it can be discarded rather than being cleaned for some applications.

Figure 14:
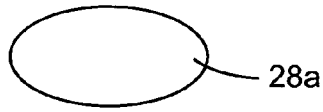
FIGS. 14, 15, 16, and 17 are enlarged illustrations of alternative shapes that could be used for outlet passageways and apertures in horns on the air cap portion included in the spraying device of FIG. 1.
Figure 15:
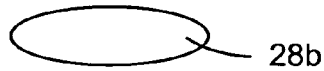
Figure 16:
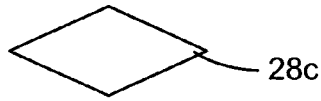
Figure 13:
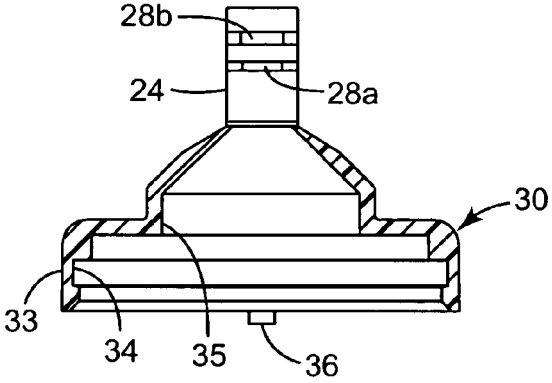
FIG. 13 is a sectional view taken approximately along line 13—13 of FIG. 12.
Figure 17:
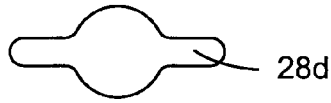

The present invention has now been described with reference to one embodiment and possible modifications thereof. It will be apparent to those skilled in the art that many changes can be made in the embodiments described without departing from the scope of the present invention. For example, the outlet passageways 28 and apertures in the air horns 24 that have a greater width in a direction at a right angle to the axis 23 than depth in a direction parallel to the axis 23 could have shapes other than rectangular, such as, but not limited to, oval shapes 28*a* and 28*b* illustrated in FIGS. 14 and 15, diamond shapes such as the diamond shape 28*c* illustrated in FIG. 16, or shapes with an enlarged (e.g., generally circular, rectangular or oval) center portions and with more narrow portions extending on opposite sides of the center portion such as the shape 28*d* illustrated in FIG. 17. Thus, the scope of the present invention should not be limited to the structures and methods described in this application, but only by the structures and methods described by the language of the claims and the equivalents thereof.

What is claimed is:

1. A liquid spray gun comprising a body assembly including a nozzle portion with an outlet end, said nozzle portion having a liquid passageway extending from an inlet end to an outlet end opening through the outlet end of the nozzle portion, said body assembly having a first air passageway extending from an inlet end to an outlet end at the outlet end of said nozzle portion, said outlet end of said first air passageway extending around said outlet end of said liquid outlet passageway and being shaped to direct air under greater than atmospheric pressure against liquid flowing out of the outlet end of the liquid outlet passageway to propel the liquid away from the outlet end of the nozzle portion while shaping the liquid into a generally conical stream about an axis, said body assembly including horns projecting past the outlet end of the nozzle on opposite sides of said axis, said body assembly having a second air passageway extending from an inlet end through portions of said horns to outlet passageways having outlet apertures spaced along said horns from the outlet end of the nozzle and facing opposite sides of said axis, said outlet passageways and apertures being non-circular and shaped to direct air under greater than atmospheric pressure flowing through said second air passageway against opposite sides of a generally conical stream of liquid formed by air flowing through the first air passageway to reshape the generally conical stream of liquid into a wide elongate stream, said body assembly including a polymeric air cap portion having said horns and means mounting said polymeric air cap portion on said nozzle portion, said air cap portion and nozzle portion having surfaces forming said first and second air passageways, said polymeric air cap portion being a molding including molded surfaces defining said non circular outlet passageways and apertures.

2. A spray gun according to claim 1 wherein said outlet passageways and apertures in said horns have a greater width in a direction at a right angle to said axis than depth in a direction parallel to said axis.

3. A spray gun according to claim 2 wherein said outlet passageways and apertures in said horns are generally rectangular.

4. A liquid spray gun comprising a body assembly including a nozzle portion with an outlet end, said nozzle portion having a liquid passageway extending from an inlet end to an outlet end opening through the outlet end of the nozzle portion, said body assembly having a first air passageway extending from an inlet end to an outlet end at the outlet end of said nozzle portion, said outlet end of said first air passageway extending around said outlet end of said liquid outlet passageway and being shaped to direct air under greater than atmospheric pressure against liquid flowing out of the outlet end of the liquid outlet passageway to propel the liquid away from the outlet end of the nozzle portion while shaping the liquid into a generally conical stream about an axis, said body assembly including horns projecting past the outlet end of the nozzle on opposite sides of said axis, said body assembly having a second air passageway extending from an inlet end through portions of said horns to outlet passageways having outlet apertures spaced along said horns from the outlet end of the nozzle and facing opposite sides of said axis, said outlet passageways and apertures being non-circular and shaped to direct air under greater than atmospheric pressure flowing through said second air passageway against opposite sides of a generally conical stream of liquid formed by air flowing through the first air passageway to reshape the generally conical stream of liquid into a wide elongate stream, said outlet passageways and apertures comprise first and second pairs of opposed outlet passageways and apertures in said horns, said first pair of outlet passageways each having a width in a direction at a right angle to said axis of about 0.154 inch or 0.39 cm, a depth in a direction parallel to said axis of about 0.35 inch or 0.89 cm, and the first pair of outlet apertures being spaced about 0.25 inch or 0.64 cm from the outlet end of the nozzle portion, and said second pair of outlet passageways each having a width in a direction at a right angle to said axis of about 0.165 inch or 0.42 cm, a depth in a direction parallel to said axis of about 0.05 inch or 0.13 cm, and the second pair of outlet apertures being spaced about 0.35 inch or 0.89 cm from the outlet end of the nozzle portion.

5. A spray gun according to claim 1 wherein said outlet end of said first air passageway is shaped to direct air exiting said first air passageway in a converging conical pattern against liquid exiting the outlet end of said liquid passageway.

6. A liquid spray gun comprising a body assembly including a nozzle portion with an outlet end, said nozzle portion having a liquid passageway extending from an inlet end to an outlet end opening through the outlet end of the nozzle portion, said body assembly having a first air passageway extending from an inlet end to an outlet end at the outlet end of said nozzle portion, said outlet end of said first air passageway extending around said outlet end of said liquid outlet passageway and being shaped to direct air under greater than atmospheric pressure against liquid flowing out of the outlet end of the liquid outlet passageway to propel the liquid away from the outlet end of the nozzle portion while shaping the liquid into a generally conical stream about an axis, said body assembly including horns projecting past the outlet end of the nozzle on opposite sides of said axis, said body assembly having a second air passageway extending from an inlet end through portions of said horns to outlet passageways having outlet apertures spaced along said horns from the outlet end of the nozzle and facing opposite sides of said axis, said outlet passageways and apertures being non-circular and shaped to direct air under greater than atmospheric pressure flowing through said second air passageway against opposite sides of a generally conical stream of liquid formed by air flowing through the first air passageway to reshape the generally conical stream of liquid into a wide elongate stream, said body assembly including a molded polymeric air cap portion having said horns and means mounting said molded polymeric air cap portion on said nozzle portion, said molded air cap portion and nozzle portion having surfaces forming said first and second air passageways, said non circular outlet passageways and apertures being formed by said molding, and said outlet passageways and apertures comprising first and second pairs of opposed non circular outlet passageways and apertures in said horns.

7. A liquid spray gun comprising a body assembly including a nozzle portion with an outlet end, said nozzle portion having a liquid passageway extending from an inlet end to an outlet end opening through the outlet end of the nozzle portion, said body assembly having a first air passageway extending from an inlet end to an outlet end at the outlet end of said nozzle portion, said outlet end of said first air passageway extending around said outlet end of said liquid outlet passageway and being shaped to direct air under greater than atmospheric pressure against liquid flowing out of the outlet end of the liquid outlet passageway to propel the liquid away from the outlet end of the nozzle portion while shaping the liquid into a generally conical stream about an axis, said body assembly including horns projecting past the outlet end of the nozzle on opposite sides of said axis, said body assembly having a second air passageway extending from an inlet end through portions of said horns to outlet passageways having outlet apertures spaced along said horns from the outlet end of the nozzle and facing opposite sides of said axis, said outlet passageways and apertures being non-circular and shaped to direct air under greater than atmospheric pressure flowing through said second air passageway against opposite sides of a generally conical stream of liquid formed by air flowing through the first air passageway to reshape the generally conical stream of liquid into a wide elongate stream, said body assembly including a molded polymeric air cap portion having said horns and means mounting said molded polymeric air cap portion on said nozzle portion, said molded air cap portion and nozzle portion having surfaces forming said first and second air passageways, said non circular outlet passageways and apertures being formed by said molding, and said means mounting said air cap portion on said nozzle portion allowing rotation of said air cap portion about said axis relative to said nozzle portion, said air cap and nozzle portions including stops limiting relative rotation of said air cap and nozzle portions to rotation through a predetermined angle between first and second relative positions, and said means mounting said air cap portion on said nozzle portion including surfaces in frictional engagement to restrict relative rotation of said air cap and nozzle portions until a predetermined torque is manually applied between said air cap and nozzle portions.

8. A liquid spray gun according to claim 7 wherein said predetermined angle is about 90 degrees.

9. A liquid spray gun comprising a body assembly including a nozzle portion with an outlet end, said nozzle portion having a liquid passageway extending from an inlet end to an outlet end opening through the outlet end of the nozzle portion, said body assembly having a first air passageway extending from an inlet end to an outlet end at the outlet end of said nozzle portion, said outlet end of said first air passageway extending around said outlet end of said liquid outlet passageway and being shaped to direct air under greater than atmospheric pressure against liquid flowing out of the outlet end of the liquid outlet passageway to propel the liquid away from the outlet end of the nozzle portion while shaping the liquid into a generally conical stream about an axis, said body assembly including horns projecting past the outlet end of the nozzle on opposite sides of said axis, said body assembly having a second air passageway extending from an inlet end through portions of said horns to outlet passageways having outlet apertures spaced along said horns from the outlet end of the nozzle and facing opposite sides of said axis, said outlet passageways and apertures being non-circular and shaped to direct air under greater than atmospheric pressure flowing though said second air passageway against opposite sides of a generally conical stream of liquid formed by air flowing through the first air passageway to reshape the generally conical steam of liquid into a wide elongate stream, said liquid spray gun further including a platform portion having through air distribution passageways including an inlet opening adapted to be connected to a supply of air under greater than atmospheric pressure, first and second air outlet openings, means for separately regulating the flow of air through said first and second air outlet openings of said air distribution passageways when air is flowing through said air distribution passageways, and manually operated means for stopping or allowing flow of air through said outlet openings of said air distribution passageways, said platform portion and said nozzle portion having manually operable means for releasably mounting said nozzle portion on said reusable platform portion with said first and second air outlet openings of said air distribution passageways communicating with the inlet ends of said first and second passageways.

10. A liquid spray gun according to claim 9 wherein said manually operable means for releasably mounting said nozzle portion on said platform portion comprises said platform portion including a support wall having opposite inner and outer surfaces, an opening through said support wall between said inner and outer surfaces, and said nozzle portion including a projection from a contact surface on the side of said nozzle portion opposite said outlet end, said projection being received in said opening through said support wall with said contact surface against said outer surface and a distal part of said projection projecting past the outer surface of said support wall, said distal part of said projection having a transverse groove, and said manually operable means further including a latch member releasably engaged in said transverse groove adapted for manual removal from said distal part.

11. A liquid spray gun according to claim 9 wherein said body assembly is molded of polymeric material, and said platform portion is made of metal.

* * * * *

UNITED STATES PATENT AND TRADEMARK OFFICE

CERTIFICATE OF CORRECTION

PATENT NO. : 7,201,336 B2
APPLICATION NO. : 10/748479
DATED : April 10, 2007
INVENTOR(S) : Russell E. Blette It is certified that error appears in the above-identified patent and that said Letters Patent is hereby corrected as shown below:

Column 7,
Line 44, delete “ho” and insert -- be --, therefor.

Column 11,
Line 32, In Claim 9, delete “though” and insert -- through --, therefor.
Line 35, In Claim 9, delete “steam” and insert -- stream --, therefor.

Signed and Sealed this

Twenty-sixth Day of February, 2008

JON W. DUDAS
*Director of the United States Patent and Trademark Office*